US008162727B2

(12) United States Patent
Zaiser

(10) Patent No.: US 8,162,727 B2
(45) Date of Patent: Apr. 24, 2012

(54) MOTOR-DRIVEN MACHINE TOOL

(75) Inventor: Adolf Zaiser, Koengen (DE)

(73) Assignee: Robert Bosch GmbH, Stuttgart (DE)

( * ) Notice: Subject to any disclaimer, the term of this patent is extended or adjusted under 35 U.S.C. 154(b) by 628 days.

(21) Appl. No.: 12/374,537

(22) PCT Filed: Feb. 20, 2008

(86) PCT No.: PCT/EP2008/052053

§ 371 (c)(1),
(2), (4) Date: Jan. 21, 2009

(87) PCT Pub. No.: WO2008/128804

PCT Pub. Date: Oct. 30, 2008

(65) Prior Publication Data

US 2009/0311952 A1 Dec. 17, 2009

(30) Foreign Application Priority Data

Apr. 19, 2007 (DE) ..... 10 2007 018 466

(51) Int. Cl.
*B24B 23/03* (2006.01)

(52) U.S. Cl. ..... 451/357

(58) Field of Classification Search ..... 451/356, 451/357, 159, 163, 344
See application file for complete search history.

(56) References Cited

U.S. PATENT DOCUMENTS

| | | | | |
|---|---|---|---|---|
| 2,367,668 | A * | 1/1945 | Champayne | 451/357 |
| 3,482,362 | A | 12/1969 | Bangerter et al. | |
| 4,729,194 | A * | 3/1988 | Maier et al. | 451/357 |
| 4,744,177 | A | 5/1988 | Braun et al. | |
| 5,425,666 | A | 6/1995 | Frank et al. | |
| 5,679,066 | A * | 10/1997 | Butz et al. | 451/357 |
| 5,868,208 | A * | 2/1999 | Peisert et al. | 173/178 |
| 6,749,493 | B2 | 6/2004 | Wuensch | |
| 2004/0117993 | A1 | 6/2004 | Armstrong | |

FOREIGN PATENT DOCUMENTS

| | | |
|---|---|---|
| CA | 1 313 309 | 2/1993 |
| CN | 1496772 | 5/2004 |
| DE | 101 04 993 | 8/2002 |
| EP | 0 303 955 | 2/1989 |
| EP | 0 591 875 | 4/1994 |
| EP | 1 428 625 | 6/2004 |

* cited by examiner

*Primary Examiner* — Hadi Shakeri
(74) *Attorney, Agent, or Firm* — Michael J. Striker

(57) ABSTRACT

A motor-driven machine tool, in particular a hand-held power tool (1) includes a rotatably driveable tool (6), a drive shaft (4) which is driven by a drive unit (2), and an output shaft (5) on which the tool (6) is mounted. It is possible to transfer the rotational motion of the drive shaft (4) via an eccentric coupling device (7) to the output shaft (5). A mass-balancing device (10) provides for oscillation compensation and is operatively connected to at least one of the shafts (4, 5) and implements a compensation motion counter to the eccentric coupling motion.

16 Claims, 5 Drawing Sheets

MOTOR-DRIVEN MACHINE TOOL

CROSS-REFERENCE

The invention described and claimed hereinbelow is also described in PCT/EP2008/052053, filed on Feb. 20, 2008 and DE 10 2007 018 466.4, filed on Apr. 19, 2007. This German Patent Application, whose subject matter is incorporated here by reference, provides the basis for a claim of priority of invention under 35 U.S.C. 119 (a)-(d).

The present invention relates to a motor-driven machine tool which includes a drive shaft driven by a drive unit, and an output shaft on which the tool is mounted.

BACKGROUND OF THE INVENTION

DE 101 04 993 A1 describes a hand-held power tool for grinding or polishing, the electric motor of which acts on a grinding disk via a transmission. A switching device is located in the transmission, which may be used to select at least two types of grinding disk motions. One object of the present invention is to realize an oscillating grinding operation, and to enable the grinding disk to carry out an exclusively rotary motion in order to polish a work piece. To realize the oscillating grinding operation, an eccentric drive is provided, via which the rotational motion of the drive shaft is converted to an eccentric motion of the grinding disk.

It is possible for grinding devices of this type which include an eccentric drive to experience out-of-balance vibrations which reduce the handling comfort of the machine tool. It must be ensured that the oscillations and vibrations do not exceed a permissible level.

SUMMARY OF THE INVENTION

The object of the present invention is to design a low-vibration, motor-driven machine tool using simple design measures, in the case of which the rotational motion of the drive shaft is transferrable to the output shaft via an eccentric coupling device.

In the case of the motor-drive machine tool according to the present invention, which is a hand-held power tool in particular, the rotational motion of the drive shaft which is acted upon by the drive motor is transferrable to the output shaft—on which the tool is mounted—with the aid of an eccentric coupling device. A mass-balancing device is provided for oscillation compensation, the mass-balancing device being operatively connected to at least one of the shafts and carrying out a compensation motion counter to the eccentric coupling motion. Due to this oscillation compensation, the vibration load is markedly reduced at least in individual operating modes of the machine tool, and oscillations may also be reduced across the entire operating range. Advantageously, the oscillations are reduced at least while the machine tool is idling, and possibly also in the working mode.

The oscillations are reduced by the fact that the mass-balancing device acts on the output shaft, and, in fact, in a manner such that the mass-balancing device carries out a compensating motion counter to the eccentric coupling motion. This compensating motion compensates—at least partially—for the rotational oscillations generated by the eccentric coupling device. Since the mass-balancing device is operatively connected at least to the output shaft, out-of-balance oscillations are compensated for close to the motor. An operative connection of the mass-balancing device to the output shaft on which the tool is mounted may also be considered.

The mass-balancing device may have various designs. One possibility is to design the mass-balancing device to include a mass-balancing member and an eccentric member which is mounted on one of the shafts, the mass-balancing member being operatively connected to the eccentric member and, in particular, being moved by it. Advantageously, the eccentric coupling device is analogous in design and includes a coupling member and an eccentric member which is mounted on one of the shafts, the coupling member being operatively connected to the eccentric member and being set into motion by it. The mass-balancing device and the eccentric coupling device are situated parallel to one another in particular. The mass-balancing member and the coupling member advantageously extend in parallel to one another, and both of the eccentric members are mounted on the same shaft, in particular on the motor-driven drive shaft. The eccentric members are designed, e.g., as eccentric cams which act on the assigned coupling member or mass-balancing member, the coupling member and mass-balancing member preferably being designed as coupling forks, the tines of which enclose the particular eccentric member. The fork tines bear against the contour of the eccentric cam and are deflected outwardly by the eccentric motion of the cam, this eccentric motion being converted via the coupling member to a pendulum motion of the output shaft on which the tool is mounted, which then carries out a rotational pendulum motion which typically includes an angular deflection of a few degrees. Due to the similar structural design of the mass-balancing device, the mass-balancing member typically carries out a corresponding motion which is counter to the eccentric coupling motion. Expediently, the two eccentric cams are offset by 180° relative to the rotational axis of the shaft.

To transfer the rotation of the drive shaft to the output shaft using the eccentric coupling device, the coupling member is preferably situated on the output shaft, so that every rotational motion of the coupling member—which is initiated by the motion of the drive shaft and the transfer via the eccentric cams—results in the desired pendulum motion. Various embodiments may be considered for the placement of the mass-balancing member, however. According to a first advantageous embodiment, the mass-balancing member is also retained on the output shaft. In this case, the mass-balancing member is rotatably supported on the output shaft, thereby making it possible for the mass-balancing member to carry out a motion counter to that of the coupling member. According to a second advantageous embodiment, however, the mass-balancing member is supported on a separate balancer shaft which is situated coaxially with the output shaft or is offset therefrom in parallel, and which is retained on the housing, in particular, of the machine tool. The oscillation compensation takes place via the action of the mass-balancing device on the drive shaft.

The machine tool according to the present invention may include a drive shaft and an output shaft which are situated at an angle to one another. In this case, the coupling member of the eccentric coupling device and the mass-balancing member of the mass-balancing device advantageously include an offset contact section which is in contact with the particular eccentric member. Another possibility is a parallel configuration of the drive shaft and output shaft, thereby making it possible to realize a particularly compact design. Given a parallel placement of the shafts, it is also possible for the coupling member and the mass-balancing member to be designed as straight lines without an offset section.

It is also advantageous to design the distance between the mass-balancing member and the assigned eccentric member to be smaller than the distance between the coupling member and the eccentric member assigned thereto. As a result, given the same eccentricity of the two eccentric members, the mass-balancing member, which is shorter, undergoes a faster angular acceleration than does the coupling member, so the mass-balancing member requires less inertia in order to balance the rotating mass. A further advantage in terms of installation space is attained as a result. This design is suited, in particular, for use with shafts which are situated at an angle to one another.

According to a further advantageous embodiment, the mass-balancing device is designed as a reciprocating mass part which is displaceably supported in a sliding guide in the housing, and which may be acted upon by the eccentric member. In contrast to the aforementioned embodiments of the mass-balancing device, in the case of which the mass-balancing member carries out a compensating rotational motion, this variant provides a preferably translatory displacement motion of the reciprocating mass part, which results in imbalance compensation. The sliding guide makes it possible for the reciprocating mass part to carry out a displacement motion relative to the housing, the sliding guide being designed, e.g. as a slot link guide having a guide pin which extends therein.

BRIEF DESCRIPTION OF THE DRAWINGS

Further advantages and expedient embodiments are depicted in the further claims, the description of the figures, and the drawings.

DETAILED DESCRIPTION OF THE PREFERRED EMBODIMENTS

Figure 1:
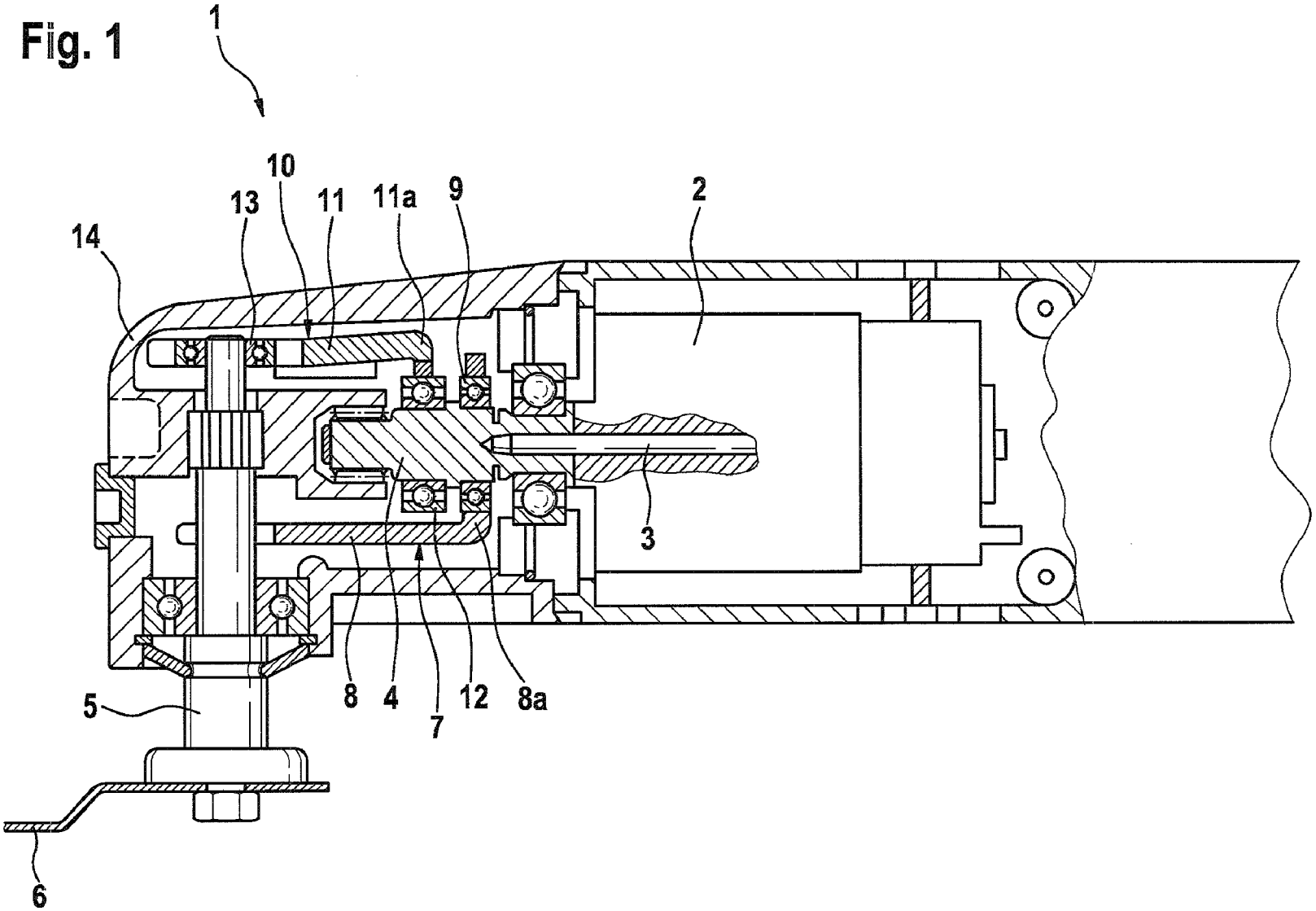
FIG. 1 shows a hand-held power tool, the tool of which performs an oscillating rotational and pendulum motion for sawing and grinding, the tool being held on an output shaft which is situated perpendicularly to a motor-driven drive shaft, the rotational motion of which is transferrable via an eccentric coupling device to the output shaft, and a mass-balancing device being provided to compensate for out-of-balance vibrations.

Components that are the same are labelled with the same reference numerals in the figures.

Hand-held power tool 1 shown in FIG. 1 includes an electric drive motor 2, the armature 3 of which is fixedly connected to a coaxial drive shaft 4 which drives an output shaft or working shaft 5 having a tool 6 mounted thereon. When electric drive motor 2 is actuated, the rotational motion of drive shaft 4 is converted via an eccentric coupling device 7 into a rotational pendulum motion of output shaft 5 and tool 6 having an angular deflection of, typically, a few degrees. It is therefore possible for tool 6 to be used for grinding, cutting, or sawing a work piece.

Eccentric coupling device 7 includes a coupling member which is fixedly connected to output shaft 5. In the embodiment, the coupling member is designed as coupling fork 8. Eccentric coupling device 7 also includes an eccentric member which is fixedly connected to drive shaft 4 and is designed as eccentric cam 9 which is non-rotatably mounted on drive shaft 4. Eccentric cam 9 has a contour which is eccentric relative to the rotational axis of drive shaft 4. An offset section 8*a*—which faces away from output shaft 5—of coupling fork 8 bears against the eccentric contour. Section 8*a* includes the two tines of the fork, which bear against opposite sides of eccentric cam 9 and touch the cam contour. The rotational axes of drive shaft 4 and output shaft 5 are perpendicular to one another. Offset section 8*a* is bent by 90°, thereby compensating for this angular deflection.

When the rotational motion of drive shaft 4 is transferred to output shaft 5 via eccentric cam device 7, a mass imbalance results. To compensate for this mass imbalance, a mass-balancing device 10 is provided, which is also located between drive shaft 4 and output shaft 5. Mass-balancing device 10 is similar in design to eccentric coupling device 7, but it produces a counter-compensation motion to compensate for the imbalances generated by the eccentric coupling device. Mass-balancing device 10 includes a mass-balancing member which is designed as a mass-balancing fork 11 located on output shaft 5, and it includes an eccentric cam 12 which is fixedly mounted on drive shaft 4. Mass-balancing fork 11 is rotatably supported on output shaft 5 via a pivot bearing 13. In accordance with the fork-shaped design of coupling fork 8 of eccentric coupling device 7, mass-balancing fork 11 is also provided with an offset section 11*a* which is bent by 90°, and which includes the two tines of the fork which bear against the contour of the assigned eccentric cam 12 which is non-rotatably mounted on drive shaft 4. Expediently, eccentric cam 12 of mass-balancing device 10 has the same structural design as eccentric cam 9 of eccentric coupling device 7, but it is situated on drive shaft 4 in a manner such that it is rotated by 180° relative thereto. As a result, shaft 4 which includes bearings 9 and 12 has no static imbalance, at the least, nor is it necessary to provide a balancing weight. It is also possible to select a deviating geometry and/or mass of eccentric cam 12 which is assigned to the mass-balancing device.

Mass-balancing fork 11 of mass-balancing device 10 is situated adjacent to the end face of output shaft 5 which faces away from tool 6. Coupling fork 8 of eccentric coupling device 7 is non-rotatably connected to the output shaft in a region between the pivot bearings of output shaft 5 in housing 14 of hand-held power tool 1. Eccentric cams 9 and 12 of eccentric coupling device 7 and mass-balancing device 10 are situated directly one behind another on drive shaft 4, with eccentric cam 9 of eccentric coupling device 7 being located further away from output shaft 5 than is eccentric cam 12 of mass-balancing device 10. Given that eccentric cams 9 and 12 are identical in design, mass-balancing fork 11 therefore undergoes a greater angular acceleration than does coupling fork 8 of eccentric coupling device 7, thereby making it possible to at least partially compensate for the smaller mass of mass-balancing fork 11, which is shorter than coupling fork 8.

Figure 2:
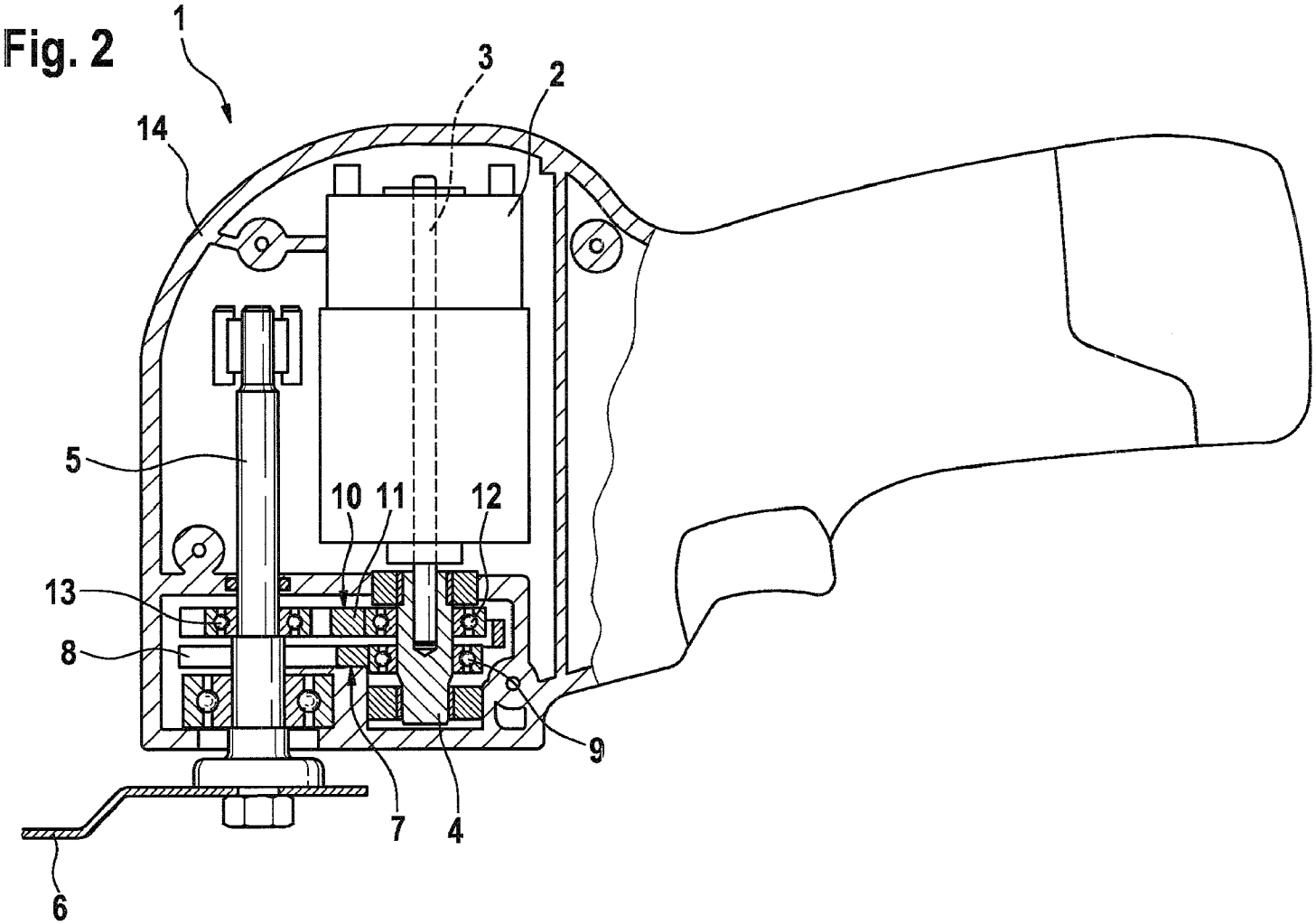
FIG. 2 shows a further embodiment of a hand-guided tool for grinding and sawing, the output shaft being situated parallel to the drive shaft.

An alternative, particularly compact design of hand-held power tool 1 is shown in FIG. 2. As in the previous embodiment, tool 6 may carry out an oscillating, rotating, pendulum motion around the rotational axis of output shaft 5 within an angular range of plus/minus a few degrees. In contrast to the previous embodiment, drive shaft 4 and output shaft 5 are located parallel to one another, thereby resulting in a compact design.

The transfer of motion between drive shaft 4 and output shaft 5 takes place via eccentric coupling device 7 which includes coupling fork 8 which is non-rotatably connected to output shaft 5, and eccentric cam 9 which is non-rotatably mounted on drive shaft 4. Given that drive shaft 4 and output shaft 5 are located parallel to one another, coupling fork 8 is designed as a straight line; an offset section is not required, in contrast to the previous embodiment.

Mass-balancing device 10 is similar in design to eccentric coupling device 7. Mass-balancing device 10 includes mass-balancing fork 11 which is rotatably supported on output shaft 5 via pivot bearing 13, and it includes assigned eccentric cam 12 which is non-rotatably mounted on drive shaft 4. Forks 8 and 11 are located directly parallel to one another, coupling fork 8 of eccentric coupling device 7 being located closer to tool 6 than is mass-balancing fork 11 of mass-balancing device 10. A reverse configuration is also possible, in which mass-balancing fork 11 is located closer to tool 6 than is coupling fork 8.

Figure 3:
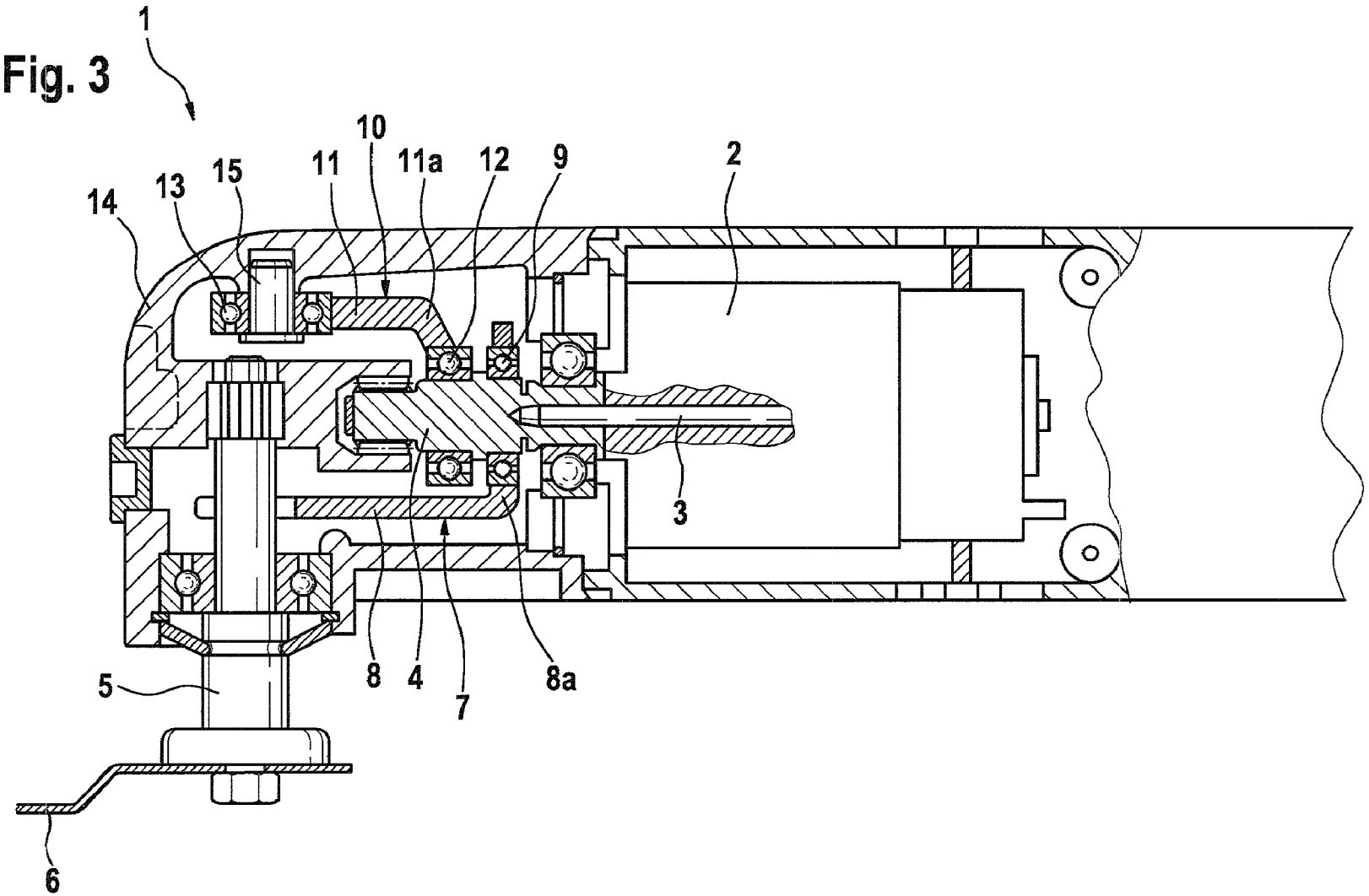
FIG. 3 shows a further embodiment, in which the mass-balancing device includes a rotatably supported mass-balancing member which is supported on a separate balancer shaft.

In the case of hand-held power tool 1 shown in FIG. 3, drive shaft 4 and output shaft 5 are situated at a 90° angle to one another, as in the first embodiment. The transfer of motion takes place via an eccentric coupling device 7 having offset coupling fork 8 and an eccentric cam 9 which is enclosed by offset section 8*a* of the coupling fork.

Mass-balancing device 10 is provided for oscillation compensation; it includes mass-balancing fork 11 with offset section 11*a* and eccentric cam 12 on drive shaft 4. In contrast to the first embodiment, mass-balancing fork 11 is not located on output shaft 5, but rather is rotatably supported on a separate balancer shaft 15 via pivot bearing 13. Balancer shaft 15 extends parallel to output shaft 5, with axial offset, and is located in the rear region of the hand-held power tool opposite tool 6. Balancer shaft 15 is fixedly accommodated in housing 14 and in a housing cover of the hand-held power tool. A design with a separate balancer shaft 15 which is located coaxially with output shaft 5 is also possible.

Figure 4:
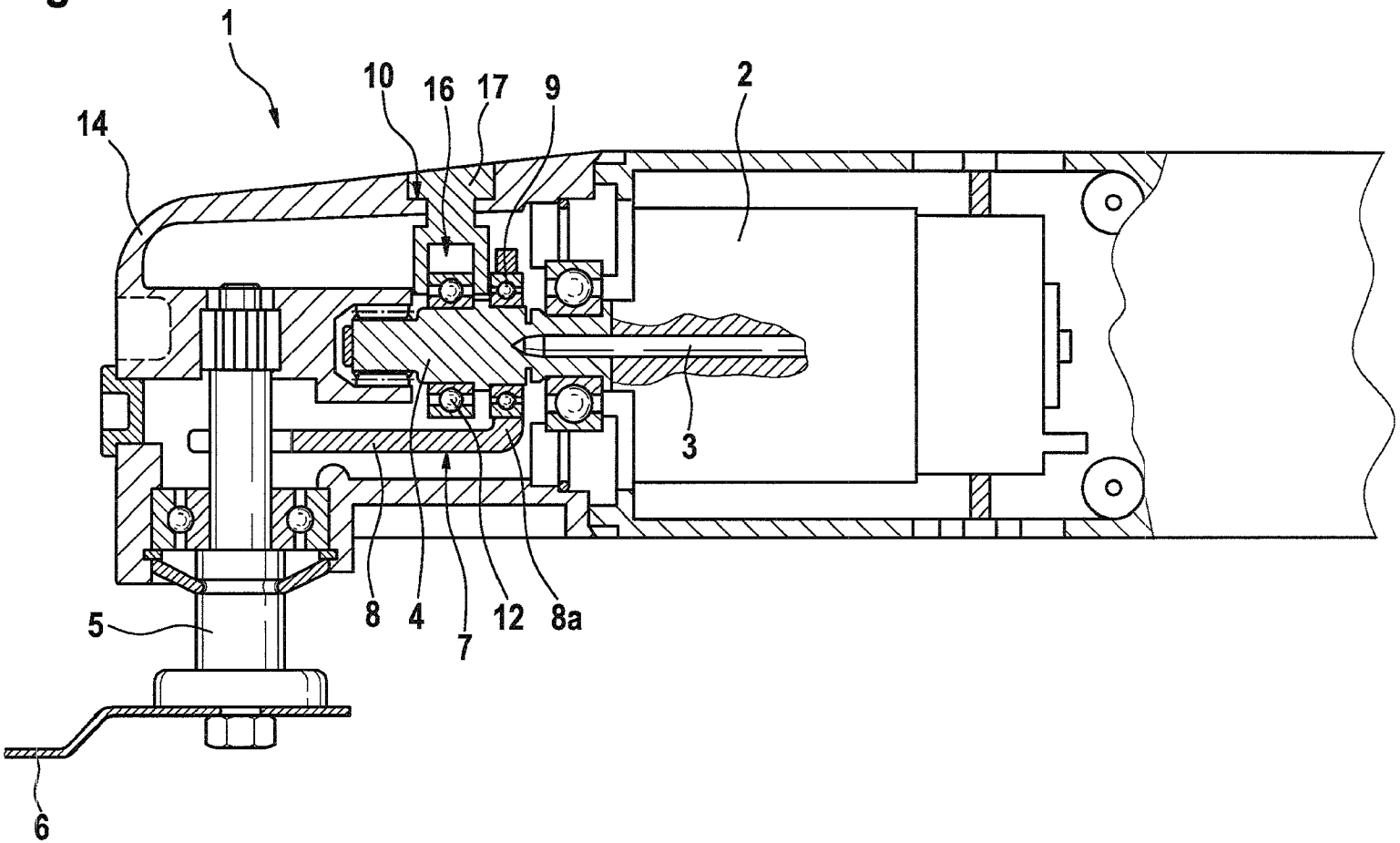
FIG. 4 shows a further embodiment of a hand-held power tool for grinding and sawing, in the case of which the mass-balancing device includes a reciprocating mass part which is displaceably supported in a sliding guide on the housing side.

In the embodiment shown in FIG. 4, drive shaft 4 and output shaft 5 are situated perpendicularly to one another, eccentric coupling device 7 with coupling fork 8 and eccentric cam 9 being provided in order to transfer motion. In this case, and in contrast to the previous embodiments, mass-balancing device 10 is not designed to include a component which is to be acted upon in a rotational manner, but rather includes a reciprocating mass part 16 which is moveable in a translatory manner. Reciprocating mass part 16 is displaced in a translatory manner in a sliding guide in the housing via eccentric cam 12 which is a component of mass-balancing device 10, thereby generating the balancing inertial forces. The sliding guide for reciprocating mass part 16 is located in a sliding guide part 17 which is connected to housing 14 of machine tool 1.

Figure 5:
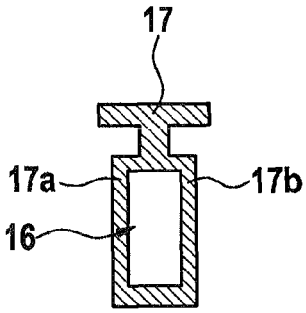
FIG. 5 shows an isolated view of the sliding guide in FIG. 4.
Figure 6:
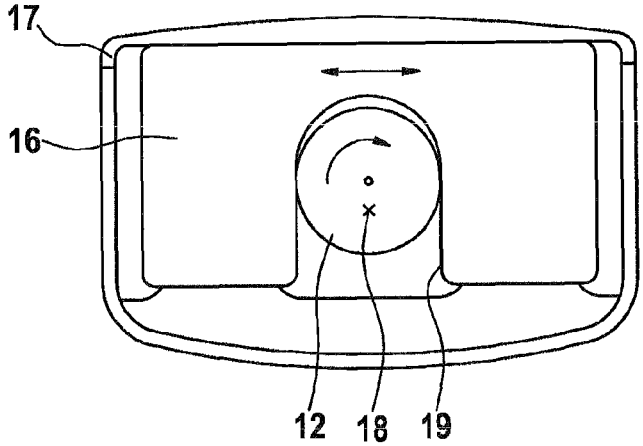
FIG. 6 shows the sliding guide including the displaceably supported reciprocating mass part which is moved to and fro in the sliding guide by an eccentric member.

FIGS. 5 and 6 show isolated views of sliding guide part 17 with reciprocating mass part 16 situated therein. Reciprocating mass part 16 may be displaced in sliding guide part 17 in an exclusively translatory manner, and, in fact, in a transverse direction relative to rotational axis 18 of drive motor 2 and eccentric cam 12 which is mounted on drive shaft 4. As shown in FIG. 6, reciprocating mass part 16 includes a U-shaped recess 19 in which eccentric cam 12 is situated. Recess 19 may also be closed in design. When eccentric cam 12 rotates, reciprocating mass part 16 is displaced to and fro in a translatory manner in the transverse direction due to the eccentric contour of eccentric cam 12. The inertial forces that occur have a compensating effect on the imbalances produced by eccentric coupling device 7. The translatory guidance takes place solely via the outer contour of reciprocating mass part 16 on assigned inner surfaces of sliding guide part 17.

To limit the movement of reciprocating mass part 16 in the axial direction of rotational axis 18 of drive shaft 14, reciprocating mass part is enclosed by side walls 17*a* and 17*b* of the sliding guide part.

Figure 7:
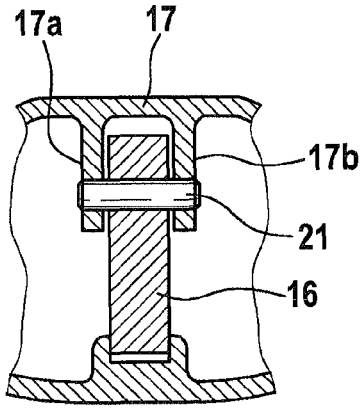
FIGS. 7 and 8 show a further mass-balancing device having a reciprocating mass part which is displaceably supported in a sliding guide.
Figure 8:
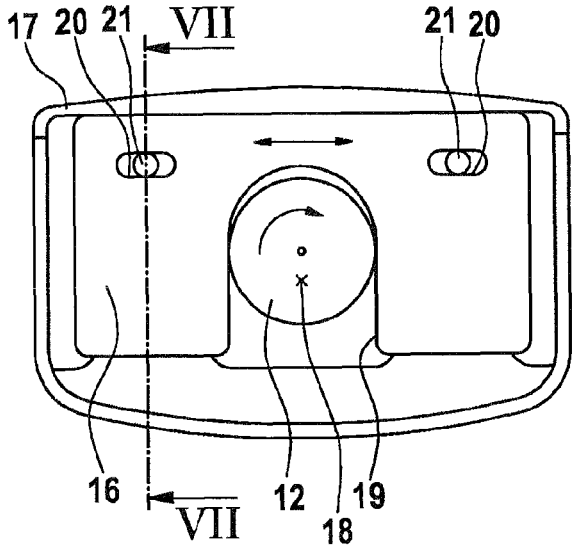

A reciprocating mass part 16 in a sliding guide part 17 is shown in an alternative design in the embodiment shown in FIGS. 7 and 8. The basic mode of operation corresponds to that of the previous embodiment, in which reciprocating mass part 16 is displaced to and fro by eccentric cam 12 in a translatory manner within sliding guide part 17. The guidance of reciprocating mass part 16 in sliding guide part 17 takes place with the aid of a slot link track 20, however, which is formed in reciprocating mass part 16, and with the aid of a guide pin 21 which is fixedly connected to sliding guide part 21. Two slot link tracks 20, each of which includes an inwardly projecting guide pin 21, are provided.

What is claimed is:

1. A motor-driven machine tool (1) comprising:

a rotatably driveable tool (6);

a drive shaft (4) driven by a drive unit (2);

an output shaft (5) on which the tool (6) is mounted;

an eccentric coupling device (7) for transferring the rotational motion of the drive shaft (4) to the output shaft (5) via an eccentric coupling motion;

a mass-balancing device (10) for oscillation compensation, the mass-balancing device (10) being operatively connected to the drive shaft (4) and implementing a compensation motion counter to the eccentric coupling motion, wherein the mass-balancing device (10) includes a mass-balancing member (11) and a first eccentric member (12) which is mounted on the drive shaft (4), the mass-balancing member (11) being operatively connected to the first eccentric member (12)

wherein the eccentric coupling device (7) includes a coupling member (8) and a second eccentric member (9) which is mounted on the drive shaft (4), the coupling member (8) being operatively connected to the second eccentric member (9), and wherein the first and second eccentric members are designed as eccentric cams (9, 12) which are fixedly connected to the drive shaft (4), and wherein the coupling member (8) and mass-balancing member (11) bear against the contour of the respective eccentric cams (9, 12).

2. The machine tool as recited in claim 1, wherein the mass-balancing member (11) of the mass-balancing device (10) is rotatably supported on the output shaft (5).

3. The machine tool as recited in claim 1, wherein the mass-balancing member (11) of the mass-balancing device (10) is supported on a separate balancer shaft (15).

4. The machine tool as recited in claim 3, wherein the balancer shaft (15) is held on a housing (14) of the machine tool (1).

5. The machine tool as recited in claim 4, wherein the balancer shaft (15) is situated such that it is parallel to and offset from the output shaft (5).

6. The machine tool as recited in claim 1, wherein the eccentric cams (9, 12) are offset from each other by 180° relative to the rotational axis (18) of the drive shaft (4).

7. The machine tool as recited in claim 1, wherein the coupling member (8) and the mass-balancing member (10)

are each fork-shaped in design defining fork tines, the fork tines enclosing respective one of said first and second eccentric cams (9, 12).

8. The machine tool as recited in claim 1, wherein the distance between the mass-balancing member (11) and the first eccentric cam (12) is less than the distance between the coupling member (8) and the second eccentric cam (9).

9. The machine tool as recited in claim 1, wherein the drive shaft (4) and output shaft (5) are situated at an angle to one another.

10. The machine tool as recited in claim 9, wherein the coupling member (8) and the mass-balancing member (11) each include an offset contact section (8*a*, 11*a*) which is in contact with the respective one of the first and second eccentric cams (9, 12).

11. The machine tool as recited in claim 1, wherein the drive shaft (4) and output shaft (5) are situated parallel to one another.

12. The machine tool as recited in claim 1, wherein the eccentric coupling device (7) is retained on the output shaft (5) between the tool (6) and the mass-balancing device (10).

13. The machine tool as recited in claim 1, wherein the mass-balancing device (10) includes a reciprocating mass part (16) defining said mass-balancing member which is displaceably supported in a sliding guide (17) and is acted upon by the first eccentric cam (12).

14. The machine tool as recited in claim 13, wherein the sliding guide (17) makes it possible for the reciprocating mass part (16) to carry out an exclusively translatory displacement motion.

15. The machine tool as recited in claim 13, wherein the sliding guide (17) includes a slot link guide having a slot link track (20) and a guide pin which is guided therein.

16. The machine tool as recited in claim 1, wherein said machine tool is a hand-held power tool.

* * * * *